US007097499B1

(12) United States Patent
Purdy

(10) Patent No.: US 7,097,499 B1
(45) Date of Patent: Aug. 29, 2006

(54) COAXIAL CABLE CONNECTOR HAVING CONDUCTIVE ENGAGEMENT ELEMENT AND METHOD OF USE THEREOF

(75) Inventor: Eric Purdy, Constantia, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/206,726

(22) Filed: Aug. 18, 2005

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS

| | | | | |
|---|---|---|---|---|
| 3,879,102 | A | 4/1975 | Horak | |
| 4,290,663 | A | 9/1981 | Fowler et al. | |
| 4,355,857 | A | 10/1982 | Hayward | |
| 4,739,126 | A | 4/1988 | Gutter et al. | |
| 4,902,246 | A | 2/1990 | Samchisen | |
| 5,046,952 | A | 9/1991 | Cohen et al. | |
| 5,066,248 | A | 11/1991 | Gaver, Jr. et al. | |
| 5,181,861 | A | 1/1993 | Gaver, Jr. et al. | |
| 5,460,544 | A | 10/1995 | Inaba et al. | |
| 5,470,257 | A | 11/1995 | Szegda | |
| 5,803,767 | A | 9/1998 | Matsumoto et al. | |
| 5,931,698 | A | 8/1999 | Kodama | |
| 6,089,912 | A | 7/2000 | Tallis et al. | |
| 6,153,830 | A * | 11/2000 | Montena | 174/88 C |
| 6,203,368 | B1 | 3/2001 | Weidner | |
| 6,217,383 | B1 | 4/2001 | Holland et al. | |
| 6,262,374 | B1 | 7/2001 | Matsumoto et al. | |
| 6,648,683 | B1 | 11/2003 | Youtsey | |
| 6,700,464 | B1 | 3/2004 | Ling et al. | |
| 6,729,911 | B1 | 5/2004 | Hu | |
| 6,805,583 | B1 | 10/2004 | Holliday et al. | |
| 6,808,415 | B1 * | 10/2004 | Montena | 439/584 |
| 6,809,265 | B1 | 10/2004 | Gladd et al. | |
| 6,910,919 | B1 | 6/2005 | Hung | |
| 2003/0095015 | A1 | 5/2003 | Loeffelholz et al. | |

* cited by examiner

*Primary Examiner*—Ross Gushi
(74) *Attorney, Agent, or Firm*—Schmeiser, Olsen & Watts

(57) ABSTRACT

A coaxial cable connector is provided, wherein the connector comprises a conductive engagement element slidably positionable around a post element of the connector and entirely within an internal cavity of a connector body of the connector. The conductive engagement element is configured to physically and electrically contact a lengthwise portion of a coaxial cable as securely affixed to the connector with a fastener member facilitating an annular environmental seal between the cable and the connector.

15 Claims, 8 Drawing Sheets

COAXIAL CABLE CONNECTOR HAVING CONDUCTIVE ENGAGEMENT ELEMENT AND METHOD OF USE THEREOF

BACKGROUND OF INVENTION

1. Technical Field

This invention relates generally to the field of connectors for coaxial cables. More particularly, this invention provides for a coaxial cable connector comprising a conductive component being interactive with the outer conductive shield of a coaxial cable and a method of use thereof.

2. Related Art

Broadband communications have become an increasingly prevalent form of electromagnetic information exchange and coaxial cables are common conduits for transmission of broadband communications. Connectors for coaxial cables are typically connected onto complementary interface ports to electrically integrate coaxial cables to various electronic devices. In addition, connectors are often utilized to connect coaxial cables to various communications modifying equipment such as signal splitters, cable line extenders and cable network modules.

To help prevent the introduction of electromagnetic interference and to facilitate proper transmission of electromagnetic communications, common coaxial cables are provided with an outer conductive grounding shield. In an attempt to further screen ingress of environmental noise and promote accurate electromagnetic information exchange, typical coaxial cable connectors are generally configured to contact with and electrically extend the conductive shield of attached coaxial cables. However, often the electrical contact between a coaxial cable and a typical coaxial cable connector is insufficient to properly extend the electrical shield between the cable and the connector. Hence, problematic electromagnetic noise is introduced via the insufficient connective juncture between the outer conductive shield of the cable and the common coaxial cable connector. Such problematic noise interference is disruptive where an electromagnetic buffer or shield is not provided by an adequate electrical and/or physical interface between the connector and the coaxial cable. Attempts have been made to increase electrical/physical contact between common coaxial cable connector components and outer conductive shield elements of standard coaxial cables. For example, U.S. Pat. No. 6,910,919 to Hung, discloses a connector having a resilient member disposed to increase electrical contact with a coaxial cable and to secure the cable to the connector. However, the physical design and corresponding operation of the connector described in Hung, leave the connector open to ingress of environmental contaminants such as moisture and dirt which can disrupt the electrical connection and interfere with proper cable communications. It is desirable for a connector to physically seal to a coaxial cable to prohibit ingress of unwanted environmental contaminants. Existing connector designs do not provide enough electrical/physical contact to ensure an adequate electromagnetic shield extension between the connector and the cable and do not provide a sufficient seal to safeguard against ingress of physical contaminants.

Accordingly, there is a need in the field of coaxial cable connectors for an improved connector design.

SUMMARY OF INVENTION

The present invention provides an apparatus for use with coaxial cable connections that offers improved reliability.

A first general aspect of the invention provides a connector for coupling an end of a coaxial cable, the coaxial cable having a center conductor surrounded by a dielectric, the dielectric being surrounded by a conductive grounding shield, the conductive grounding shield being surrounded by a protective outer jacket, said connector comprising a connector body having an internal cavity, a post element operable within the internal cavity of the connector body, the post element having a first end adapted to be inserted into an end of the coaxial cable around the dielectric and under the conductive grounding shield thereof, a conductive engagement element slidably positionable around the post element and entirely within the internal cavity of the connector body, wherein the conductive engagement element is configured with a substantially annular ring adapted to fit around the conductive grounding shield of the coaxial cable, the substantially annular ring having flexible members extending therefrom and away from the first end of the post element when the conductive engagement element is slidably positioned around the post element, and a fastener member, wherein said fastener member facilitates an annular environmental seal around the coaxial cable as said fastener member is compressed toward the connector body.

A second general aspect of the invention provides a connector for coupling an end of a coaxial cable, the coaxial cable having a center conductor surrounded by a dielectric, the dielectric being surrounded by a conductive grounding shield, the conductive grounding shield being surrounded by a protective outer jacket, said connector comprising a connector body having a first end for receiving the coaxial cable, a post element adapted to be fastened to an end of the coaxial cable when the cable is received into the first end of the connector body, a fastener member, wherein said fastener member operates with the post element and connector body to form an annular compression seal around the coaxial cable, and a conductive engagement element configured to substantially encircle and electrically contact a lengthwise portion of the conductive grounding shield of the coaxial cable as the coaxial cable is received by the connector body and fastened to the post element.

A third general aspect of the invention provides a connector for coupling an end of a coaxial cable, the coaxial cable having a center conductor surrounded by a dielectric, the dielectric being surrounded by a conductive grounding shield, the conductive grounding shield being surrounded by a protective outer jacket, said connector comprising a connector body having an internal cavity extending from a first end of the connector body, the internal cavity adapted to receive the coaxial cable, a post element having a first end adapted to be inserted into an end of the coaxial cable around the dielectric and under the conductive grounding shield thereof when the cable is received into the first end of the connector body, a fastener member, operable to create an annular environmental seal around the coaxial cable as said fastener member is compressed toward the connector body, and means for enhancing the annular electrical contact between the connector body and a lengthwise portion of the conductive grounding shield of the coaxial cable as positioned over the first end of the post element when inserted into the end of the coaxial cable.

A fourth general aspect of the invention provides a method for electrically coupling a coaxial cable and a connector, the coaxial cable having a center conductor surrounded by a dielectric, the dielectric being surrounded by a conductive grounding shield, the conductive grounding shield being surrounded by a protective outer jacket, said method comprising providing a connector, wherein the connector includes a connector body having an internal cavity adapted to receive the coaxial cable, a post element adapted to be fastened to an end of the coaxial cable when the cable is received into the internal cavity of the connector body, a fastener member, wherein said fastener member operates with the post element and connector body to form an annular compression seal around the coaxial cable, and a conductive engagement element, configured to substantially encircle and electrically contact a lengthwise portion of the conductive grounding shield of the coaxial cable as the coaxial cable is received by the connector body and fastened to the post element. The method also comprises enhancing electrical contact between the coaxial cable and the connector body by fastening the post element to the coaxial cable, positioning the conductive engagement element around a lengthwise portion of the conductive grounding shield of the coaxial cable, and inserting the coaxial cable into the internal cavity of the connector body, wherein the conductive engagement element resides physically and electrically between the connector body and the conductive grounding shield of the coaxial cable as fastened to the post element. Moreover, the method comprises securing the coaxial cable to the connector by compressing the fastener member and forming an annular seal around the coaxial cable protecting the connector against entry of unwanted environmental contaminants and fixing the cable to the connector.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
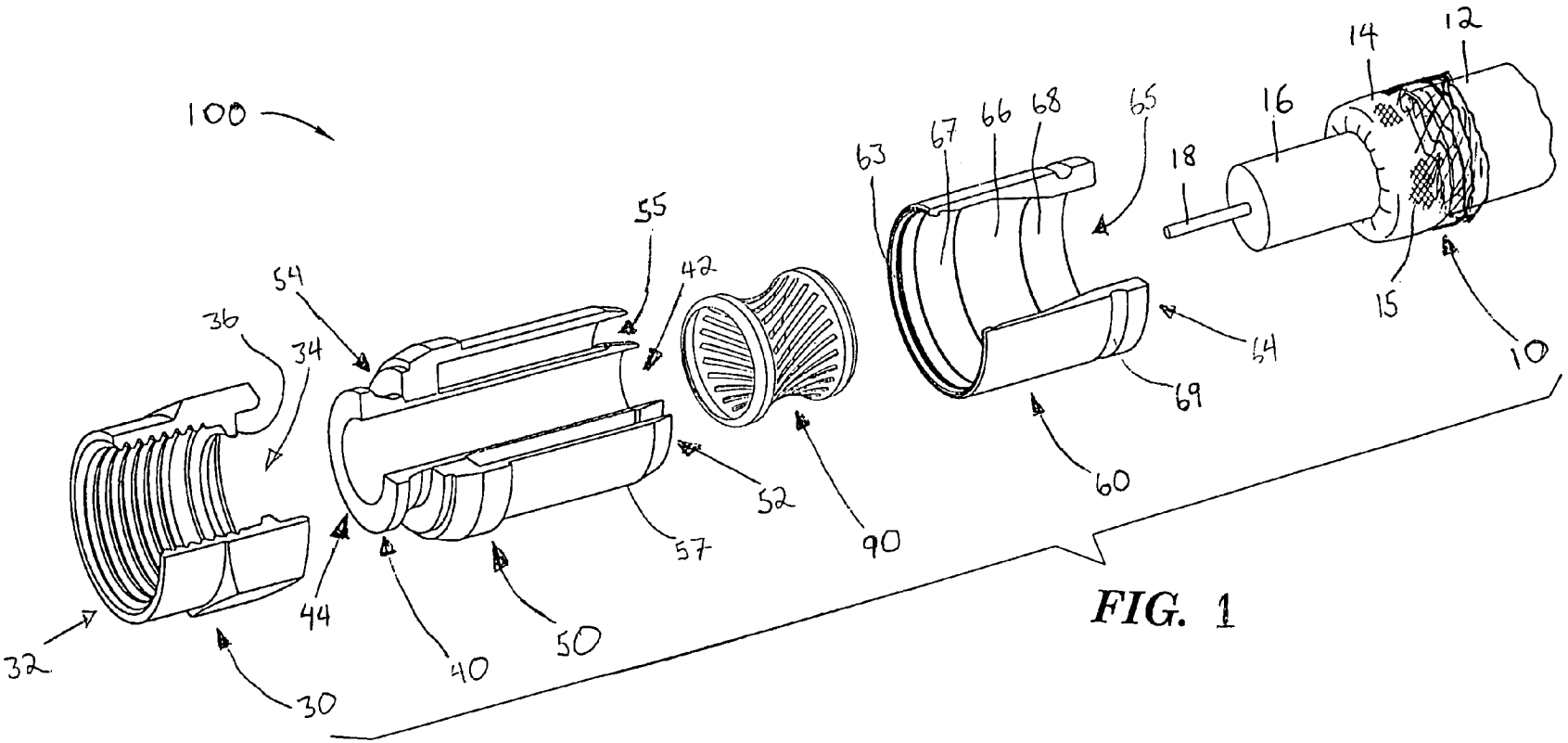
FIG. 1 depicts a partially exploded, partially cut-away view of one embodiment of a connector, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts a partially exploded, partially cut-away view of one embodiment of a connector 100 in accordance with the present invention. The connector 100 may include a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. The conductive grounding shield 14 may be configured with various interstitial patterns of foil and/or braided to layers. For example, FIG. 1 shows interstices 15 of the conductive grounding shield 14 as exposed during preparation of the coaxial cable 10 for installation with a connector 100. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring still further to FIG. 1, an embodiment of the connector 100 may further include a threaded nut 30 having a first end 32 and opposing second end 34. The threaded nut 30 may comprise an internal lip 36 located proximate the second end 34 and configured to hinder axial movement of the post element 40. The threaded nut 30 may be formed of conductive materials facilitating grounding through the nut. Moreover, the threaded nut 30 may be formed of both conductive and non-conductive materials. For example the internal lip 36 may be formed of a polymer, while the remainder of the nut 30 may be comprised of a metal or other conductive material. In addition, the threaded nut 30 may be formed of metals or polymers or other materials that would facilitate a rigidly formed body.

With further reference FIG. 1, embodiments of a connector 100 may include a post element 40. The post element 40 may comprise a first end 42 and opposing second end 44. Furthermore, the second end 44 of the post element 40 may be configured to operatively contact internal lip 36 of threaded nut 30, thereby facilitating the prevention of axial movement of the post element 40 beyond the contacted internal lip 36. The post element 40 may be formed such that portions of a prepared coaxial cable 10 including the dielectric 16 and center conductor 18 may pass axially into the first end 42 and/or through the body of the post element 40. Moreover, the post element 40 should be dimensioned such that the post element 40 may be inserted into an end of the prepared coaxial cable 10, around the dielectric 16 and under the protective outer jacket 12 and conductive grounding shield 14. The post element 40 may be fastened to the coaxial cable 10. Further, the post element 40 may be dimensioned such that a conductive engagement element 90 may be slidably positionable around the post element 40 and entirely within an internal cavity 55 of a connector body 50. Accordingly, where an embodiment of the post element 40 may be inserted into an end of the prepared coaxial cable 10 under the drawn back conductive grounding shield 14 substantial physical and/or electrical contact with the conductive grounding shield 14 may be accomplished thereby facilitating grounding and the extension of an electromagnetic buffer through the post element 40. The post element 40 may be formed of metals or other conductive materials that would facilitate a rigidly formed body. In addition, the post element 40 may also be formed of non-conductive materials such as polymers or composites that facilitate a rigidly formed body. In further addition, the post element 40 may be formed of a combination of both conductive and non-conductive materials. For example, a metal coating or layer may be applied to a polymer of other non-conductive material. The post element 40 may operate with a connector body 50, wherein an outer radial surface of the post element 40 may engage an inner radial surface of the connector body 50.

Accordingly, as shown further in FIG. 1, embodiments of a connector 100 may include a connector body 50. The connector body 50 may comprise a first end 52 and opposing second end 54. In addition, the connector body 50 may include a semi-rigid, yet compliant outer surface 57. The outer surface 57 may be configured to form an annular seal around the coaxial cable 10 when the first end 52 is deformably compressed against a received coaxial cable 10 by a fastener member 60. Moreover, the connector body 50 may include an internal cavity 55 axially extending from the first end 52 of the connector body 50. The internal cavity 55 may be configured having dimension sufficient to receive a prepared coaxial cable 10. The connector body 50 may be formed of materials such as, polymers, bendable metals or composite materials that facilitate a semi-rigid, yet compliant outer surface 57. Further, the connector body 50 may be formed of conductive materials or a combination both conductive and non-conductive materials.

While the connector body is shown in FIG. 1 engaging the post element 40, it should be understood by those of ordinary skill that the connector body 50 and post element 40 may be separately disengageable components. Moreover, it should further be understood that various embodiments of a connector 100 may include connector body 50 having an integral (non-disengageable) post element 40. Such an integral post element 40 of a connector body 50 in an embodiment of a connector 100 may render connector operability similar to the functionality of connector 100 embodiments having separately engageable post element 40 and connector body 50 components. For example, an integral post element 40 of a connector body 50 may be formed such that portions of a prepared coaxial cable 10 including the dielectric 16 and center conductor 18 may pass axially into a first end 42 and/or through an integral post element 40. Moreover, an integral post element 40 may be dimensioned such that a portion of such an integral post element 40 may be inserted into an end of a prepared coaxial cable 10, around the dielectric 16 and under the protective outer jacket 12 and conductive grounding shield 14. Such an integral post element 40 may be fastened to the coaxial cable 10. Further, an integral post element 40 may be dimensioned such that a conductive engagement element 90 may be slidably positionable around the post element 40 and entirely within the internal cavity 55 of the connector body 50. Furthermore, the outer surface 57 of a connector body 50 having an integral post element 40 may render connector 100 operability similar to the functionality of a connector 100 having a separately engageable (non-integral) connector body 50. Hence, the outer surface 57 of a connector body 50 having an integral post element 40 may be semi-rigid, yet compliant. The outer surface 57 may be configured to form an annular seal when compressed against a coaxial cable 10 by a fastener member 60. In addition, an integral post element 40 may be integrally joined with a connector body 50 such that the joining may form an unbroken surface between the post element 40 and the connector body 50 and may provide additional physical/electrical contact points for grounding with a conductive grounding shield 14 of a coaxial cable 10 and/or a conductive engagement element 90.

Figure 4:
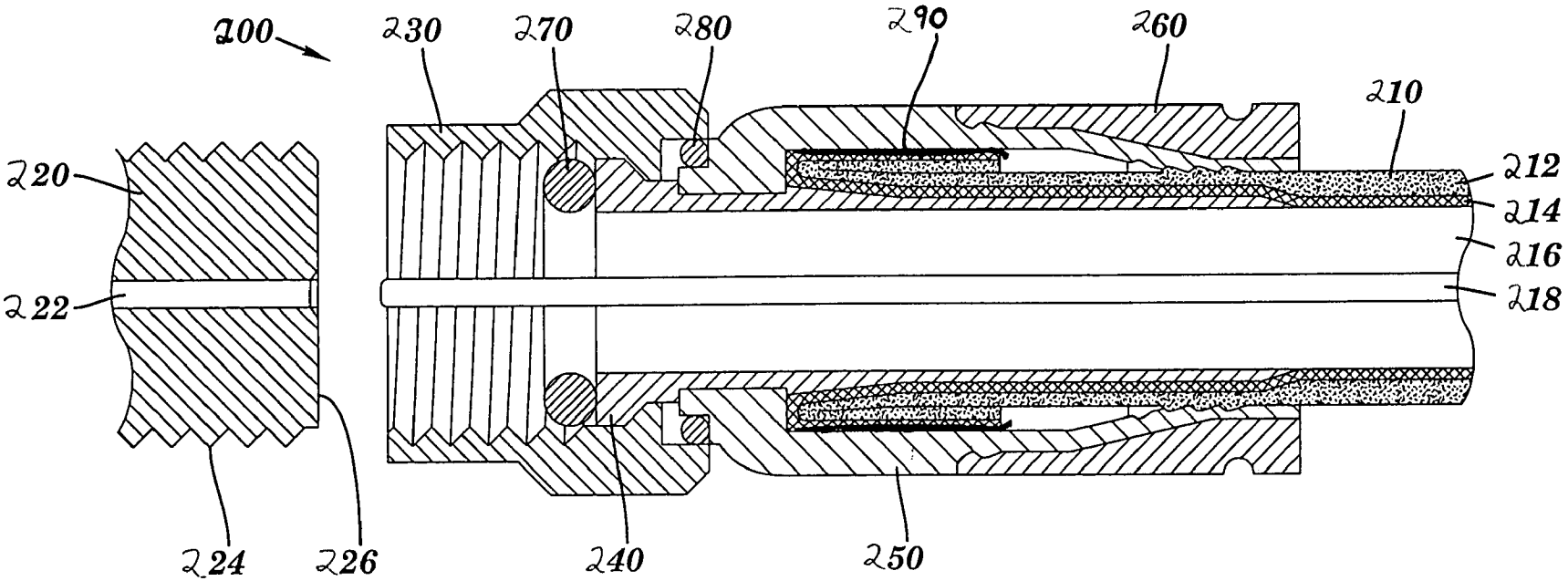
FIG. 4 depicts a sectional side view of another embodiment of a connector, in accordance with the present invention.

Referring further still to FIG. 1, embodiments of a connector 100 may also include a fastener member 60. The fastener member 60 may have a first end 62 and opposing second end 64. In addition, the fastener member 60 may include an internal annular protrusion 63 located proximate the first end 62 of the fastener member 60 and configured to help facilitate secure engagement with the outer surface 57 of connector body 50. Moreover, the fastener member 60 may comprise a central passageway 65 defined between the first end 62 and second end 64 and extending axially through the fastener member 60. The central passageway 65 may comprise a ramped surface 66 which may be positioned between a first opening or inner bore 67 having a first diameter positioned proximate with the first end 62 of the fastener member 60 and a second opening or inner bore 68 having a second diameter positioned proximate with the second end 64 of the fastener member 60. The ramped surface 66 may act to deformably compress the outer surface 57 of a connector body 50 when the fastener member 60 is operated to secure a coaxial cable 10. Since the diameter of the second opening or inner bore 68 of fastener member 60 may be smaller than the outer surface 57 portion of the connector body 50 accepting the fastener member 60, the connector body 50 may be concentrically gripped so that the volume of the internal cavity 55 may be decreased. That is, the outer surface 57 of the connector body 50 may be displaced or moved and compressed radially inwardly to decrease the volume of the internal cavity 55 when the fastener member 60 is slidingly moved toward the second end 54 of the connector body 50. Compression and slidable movement of the fastener member may be effected by a compression tool. Examples of such tools may be PPC tools having model numbers VT-200 and VT-300 or Ripley tools having model numbers CAT-AS-EX and CAT-AS. As a result of the compression of the fastener member 60, the coaxial cable 10 may be firmly gripped or clamped between the post element 40 and connector body 50. In this manner, the post element 40 may cooperate with the connector body 50 to provide a generally continuous, annular, substantially 360° environmental seal and grip on the coaxial cable 10. An example of this compression-type seal as effected by another alternate embodiment of a connector 200 is depicted in FIG. 4. Advantageously, the operation of the fastener member 60 works to facilitate a seal against unwanted ingress of environmental contaminants between the connector body 50 and the fastener member 60, and can accommodate a wide range of coaxial cable 10 types and sizes. Thus the need for connectors of various sizes can be avoided with a universal connector 100 of the present invention.

Additionally, the fastener member 60 may comprise an exterior surface feature 69 positioned proximate with the second end 64 of the fastener member 60. The surface feature 69 may facilitate gripping of the fastener member 60 during operation of the connector 100. Although the surface feature is shown as an annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, polymers, composites and the like.

With further reference to FIG. 1, embodiments of a connector 100 may include a conductive engagement element 90. Manufacture of the various components of the connector 100 including, but not limited to the threaded nut 30, post element 40, connector body 50, fastener member 60 and conductive engagement element 90 may comprise casting, extruding, cutting, stamping, punching, turning, drilling, rolling, injection molding, spraying, blow molding, or other fabrication methods that may provide efficient production of the various connector 100 components.

Figure 2:
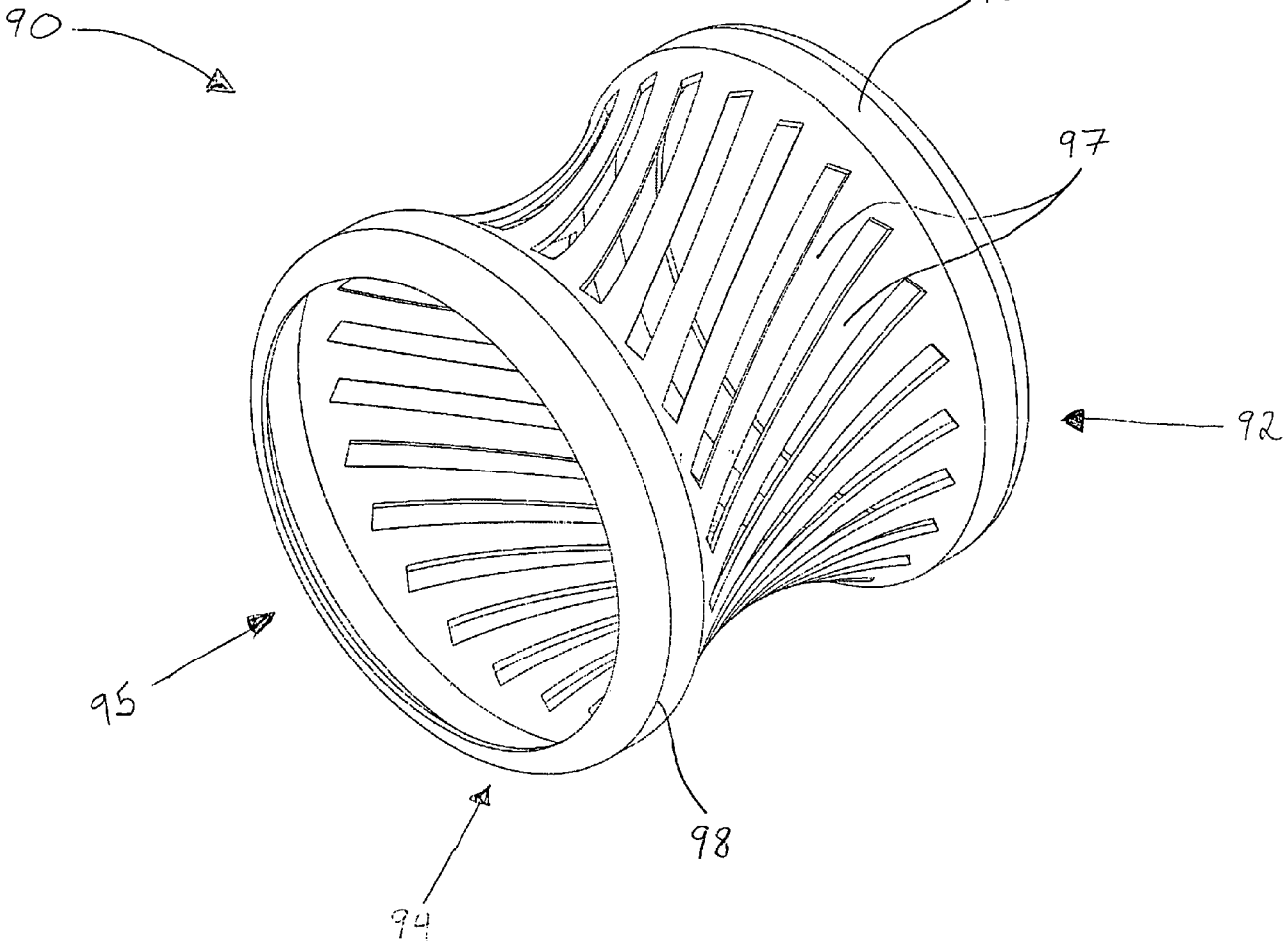
FIG. 2 depicts a perspective view of an embodiment of a conductive engagement element, in accordance with the present invention.

With continued reference to the drawings, FIG. 2 depicts a perspective view of an embodiment of a conductive engagement element 90, in accordance with the present invention. The conductive engagement element 90 should be formed of a conductive material. Such materials may include, but are not limited to conductive polymers, plastics, conductive elastomers, conductive elastomeric mixtures, composite materials having conductive properties, metals, metal alloys, conductive rubber, and/or the like and/or any workable combination thereof. Moreover, the conductive engagement element may include a first end 92 and opposing second end 94. The first end 92 may be adapted to receive at least a portion of a coaxial cable 10 (shown in FIG. 1), wherein the coaxial cable 10 may be inserted into and/or through a central passageway 95 of the conductive engagement element 90. A substantially annular ring 96 may be formed on the first end 92 of the conductive engagement element 90 such that the substantially annular ring 96 may contact a lengthwise portion of the coaxial cable 10 when inserted into and/or through the central passageway of the conductive engagement element 90. In addition, the conductive engagement element may include flexible members 97 extending away from the substantially annular ring 96. The size of, number of, and/or direction of extension of the flexible members 97 running away from the substantially annular ring 96 may vary. For example, as embodied in FIG. 2, the conductive engagement element 90 may include several flexible members 97 having similar widths separated by equidistant slots therebetween, the slots having the same width as the flexible members 97, wherein the flexible members 97 and interspersed slots extend in a diagonal, helical-like fashion forming a twisted casing-like structure surrounding the central passageway 95 of the conductive engagement element 90. The flexible members 97 may run to and connect with another substantially annular ring 98 formed on the second end 94 of the conductive engagement element 90. However, other conductive engagement element 90 embodiments may not include a second substantially annular ring 98 to which the flexible members 97 may run; the extension of the flexible members 97 may terminate without adjoining another substantially annular ring 98. Furthermore, other conductive engagement element 90 embodiments may include flexible members 97 extending parallel with the axis of the central passageway 95 (non-diagonally), wherein various slots formed therebetween may create spacing between the flexible members 97 that is not equidistant. Still further, the flexible members 97 may be connected together in locations away from the substantially annular ring 96. For example, the members may form a substantially annular grid-like structure having flexible properties. Even further still, the flexible members 97 may bend or concave radially inward while extending away from the substantially annular ring 96. Accordingly, the flexible members may engage a coaxial cable 10 (see FIG. 1) when inserted into and/or through the central passageway 95 of the conductive engagement element 90. Where the flexible members 97 extend in a helical-like fashion, they may contact the coaxial cable 10, as inserted, in a wiping-type manner which may increase the contact between the conductive engagement element 90 and the coaxial cable 10. In addition, flexible members may be configured to surround the central passageway 95 and may be adapted to fit around an outer surface of a post element 40 and adapted to fit radially within at least a portion of a connector body 50 and a fastener member 60 (also shown in FIG).

Figure 3:
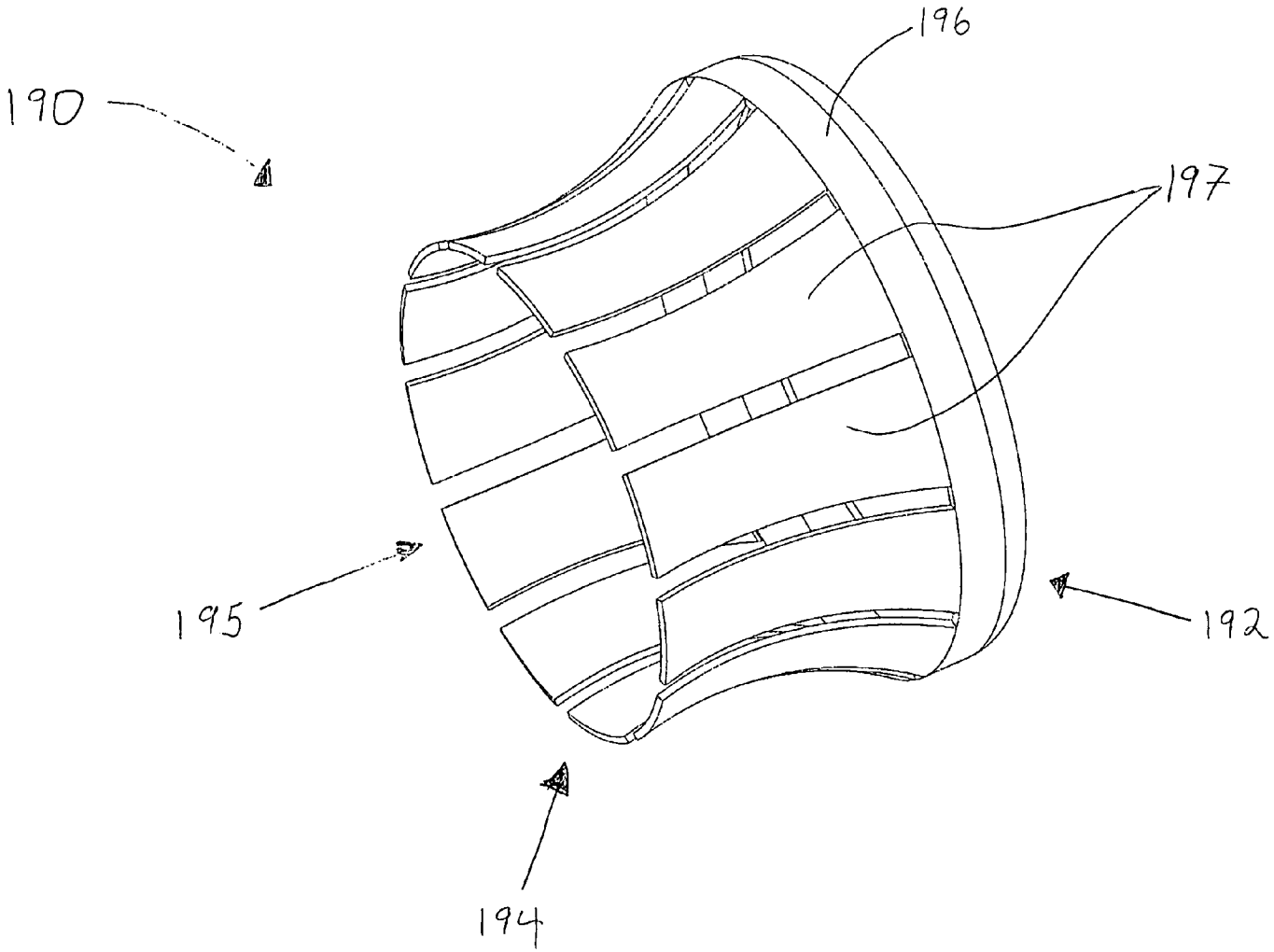
FIG. 3 depicts a perspective view of an additional embodiment of a conductive engagement element, in accordance with the present invention.

With additional reference to the drawings, FIG. 3 is illustrative of a perspective view of an additional embodiment of a conductive engagement element 190, in accordance with the present invention. The conductive engagement element 190 may include a central passageway 195, wherein the central passageway 195 may reside axially between a first end 192 and opposing second end 194 of the conductive engagement element 190. Moreover, like the embodied conductive engagement element 90 shown in FIG. 2, the conductive engagement element 190 embodiment may include a substantially annular ring 196 formed at the first end 192 of the conductive engagement element 190 and may include flexible members 197 extending away from the substantially annular ring 196. However, the flexible members 197 of the conductive engagement element 190 may terminate in themselves at the second end 194 of the conductive engagement element 190. Furthermore, the flexible members 197 may be divided by slots of smaller width than the width of the flexible members 197. Further still, the flexible members 197 may extend in a direction parallel with the axis of the central passageway 195 and may not twist in a diagonal, helical-like fashion. The flexible members 197 of the conductive engagement element 190 embodiment may bend and concave radially inward. Additionally, the substantially annular ring 196 and the flexible members 197 may be configured to physically and electrically contact a lengthwise portion of a coaxial cable 10.

Referring further reference to the drawings, FIG. 4 depicts a sectional side view of another embodiment of a connector 200, in accordance with the present invention. As shown, the connector may be securely attached with a coaxial cable 210. The coaxial cable 210 may include a center conductor 218 extending axially through the length of the connector 200. Moreover, the coaxial cable 210 may have a dielectric 216 exposed and inserted through a post element 240 of the connector 200. Furthermore, the coaxial cable 210 may include a conductive grounding shield 214 in contact with an external surface of the post element 240 and/or an internal surface of a connector body 250 as the conductive grounding shield is bent or peeled back on itself and over a protective outer jacket 212 of the coaxial cable 210. The connector 200 may also include a threaded nut 230. Additionally, the connector 200 may include a seal member 270 which may be located axially within the threaded nut 230 and may physically contact the post element 240. Still further, the connector 200 may include a seal member 280 which may be located between an internal surface of the threaded nut 230 and an external surface of the connector body 250. Both the seal member 270 and seal member 280 may be O-rings configured to effect an annular seal within the connector and at the various locations wherein the seal members 270 and 280 may be located. It should be appreciated by those of ordinary skill in the art that the annular seal effected by either or both of the seal member 270 and the seal member 280 may be a physical seal protecting the connector from entry of unwanted physical environmental contaminants and/or an electrical seal, extending the grounding shield or electromagnetic buffer pertinent to the connector 200 and precluding entry of unwanted electrical interference. The coaxial cable 210 may be securely and sealingly attached with the connector 200 through operation of a fastener member 260. The fastener member may compress the connector body 250, cable 210 and post element 240 together annularly, thereby affixing the corresponding component parts and facilitating an environmental seal between them. The fastener member may operate with a compression tool. In addition, the connector 200 may include a conductive engagement element 290 operable with the connector body 250, coaxial cable 210 and or post element 240 to enhance the electrical connection and boost the electromagnetic shielding capability of the connector 200.

Referring further to FIG. 4, the connector 200 may also interact with a coaxial cable interface port 220. The coaxial cable interface port 220 includes a conductive receptacle 222 for receiving a portion of a coaxial cable center conductor 218 sufficient to make adequate electrical contact. The coaxial cable interface port 220 may further comprise a threaded exterior surface 224, although various embodiments may employ a smooth as opposed to threaded exterior surface. In addition, the coaxial cable interface port 220 may comprise a mating edge 226. It should be recognized that the radial thickness and/or the length of the coaxial cable interface port 220 and/or the conductive receptacle 222 may vary based upon generally recognized parameters corresponding to broadband communication standards and/or equipment. Moreover, the pitch and height of threads which may be formed upon the threaded exterior surface 224 of the coaxial cable interface port 220 may also vary based upon generally recognized parameters corresponding to broadband communication standards and/or equipment. Furthermore, it should be noted that the interface port 220 may be formed of a single conductive material, multiple conductive materials, or may be configured with both conductive and non-conductive materials corresponding to the port's 220 electrical interface with a connector 200. For example, the threaded exterior surface may be fabricated from a conductive material, while the material comprising the mating edge 226 may be non-conductive or vise versa. However, the conductive receptacle 222 should be formed of a conductive material. Further still, it will be understood by those of ordinary skill that the interface port 220 may be embodied by a connective interface component of a communications modifying device such as a signal splitter, a cable line extender, a cable network module and/or the like.

Figure 5:
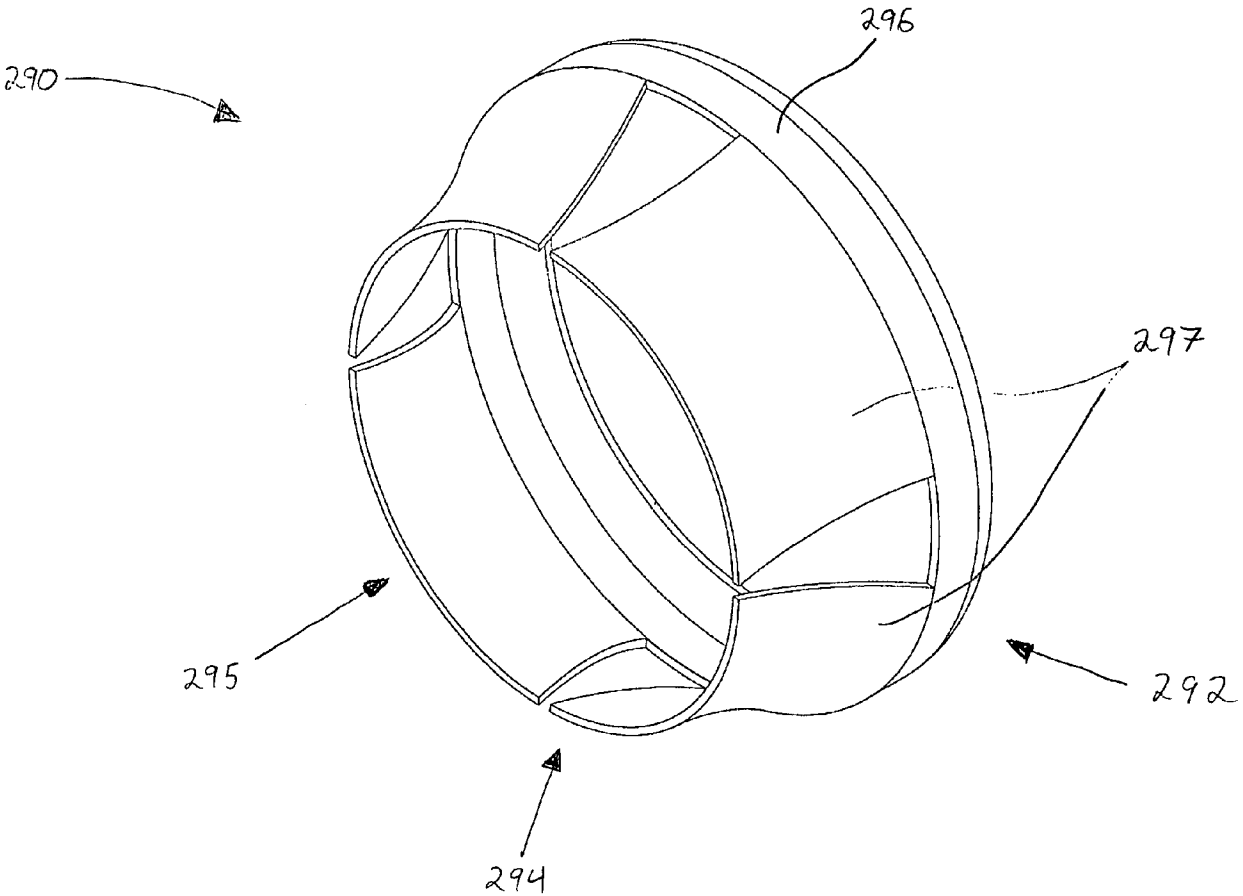
FIG. 5 depicts a perspective view of another embodiment of a conductive engagement element, in accordance with the present invention.

With additional reference to the drawings, FIG. 5 depicts a perspective view of another embodiment of a conductive engagement element 290, in accordance with the present invention. Similar to the embodied conductive engagement element 90 shown in FIG. 2, the conductive engagement element 290 embodiment may include a substantially annular ring 296 formed at a first end 292 of the conductive engagement element 290. Moreover, the conductive engagement element 290 may include flexible members 297 which run away from the substantially annular ring 296. Additionally, the conductive engagement element 290 may include a central passageway 295, wherein the central passageway 295 may reside axially between the first end 292 and an opposing second end 294 of the conductive engagement element 290. Like the flexible members 197 of the conductive engagement element 190 shown in FIG. 3, the flexible members 297 of the conductive engagement element 290 may terminate in themselves at the second end 294 of the conductive engagement element 290. Furthermore, the flexible members 297 may extend in a direction parallel with the axis of the central passageway 295 and may not twist in a diagonal, helical-like fashion. Further still, the flexible members 297 of the conductive engagement element 290 embodiment may bend and concave radially inward. In addition, the substantially annular ring 296 and the flexible members 297 of the conductive engagement element 290 may be configured to physically and electrically contact a lengthwise portion of a coaxial cable 10. The number of flexible members 297 of conductive engagement element 290 may be limited to four members 297 divided by slots of smaller width than the width of the flexible members 297. Accordingly, the combined width of the flexible members 297 may comprise a considerable portion of the annular width of material surrounding the central passageway 295. Hence, a conductive engagement element 290 including flexible members having considerable width may be effective in physically and electrically contacting conductive grounding shields of coaxial cables, wherein the conductive grounding shield comprises a smooth metal foil. However, it should be understood the various embodiments of a conductive engagement element 290 may be effective in enhancing the grounding of a coaxial cable 210 in a connector 200 (as shown in FIG. 4).

Figure 6:
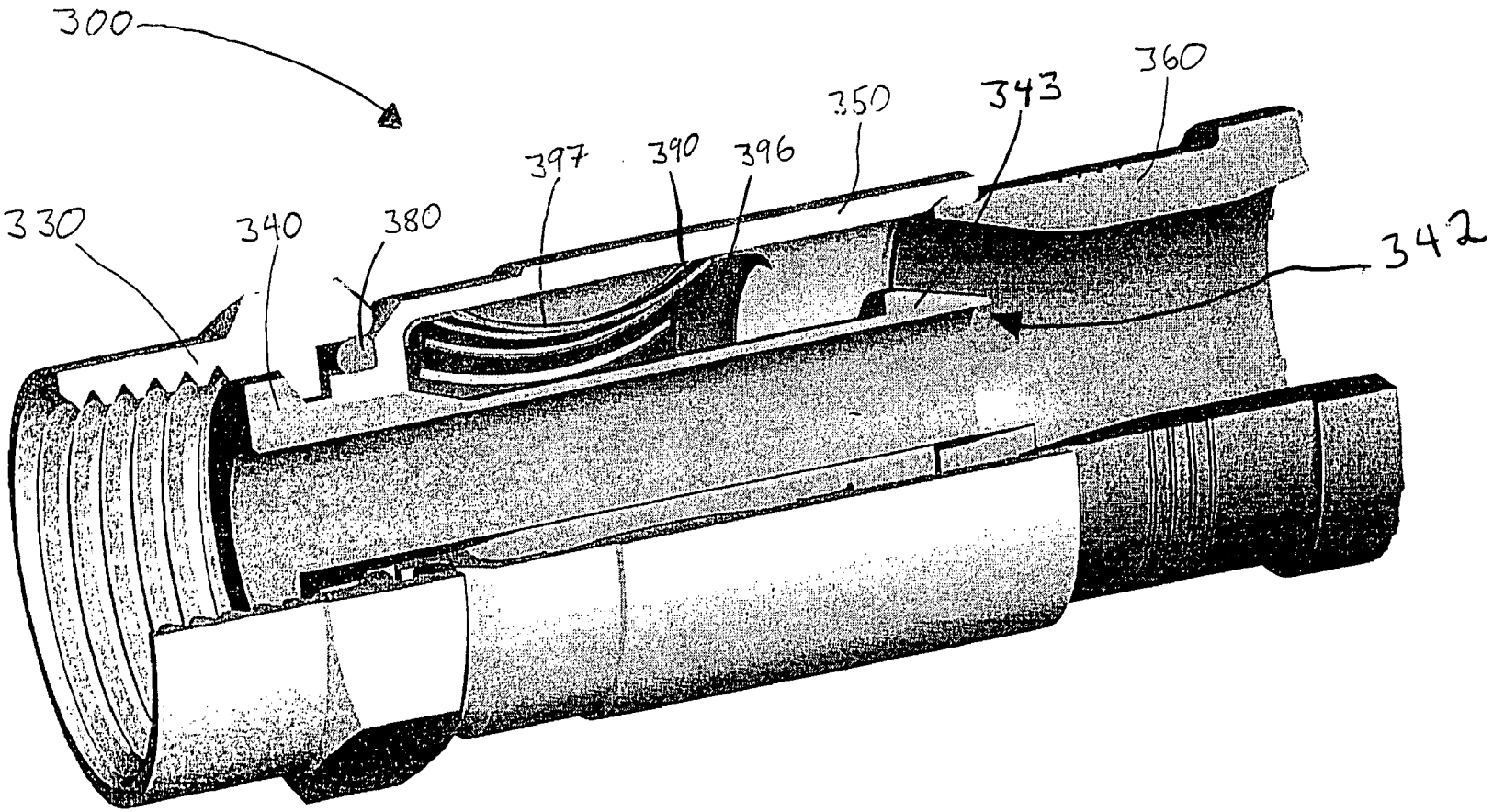
FIG. 6 depicts a cut-away perspective view of a further embodiment of a connector without an inserted coaxial cable, in accordance with the present invention.
Figure 8:
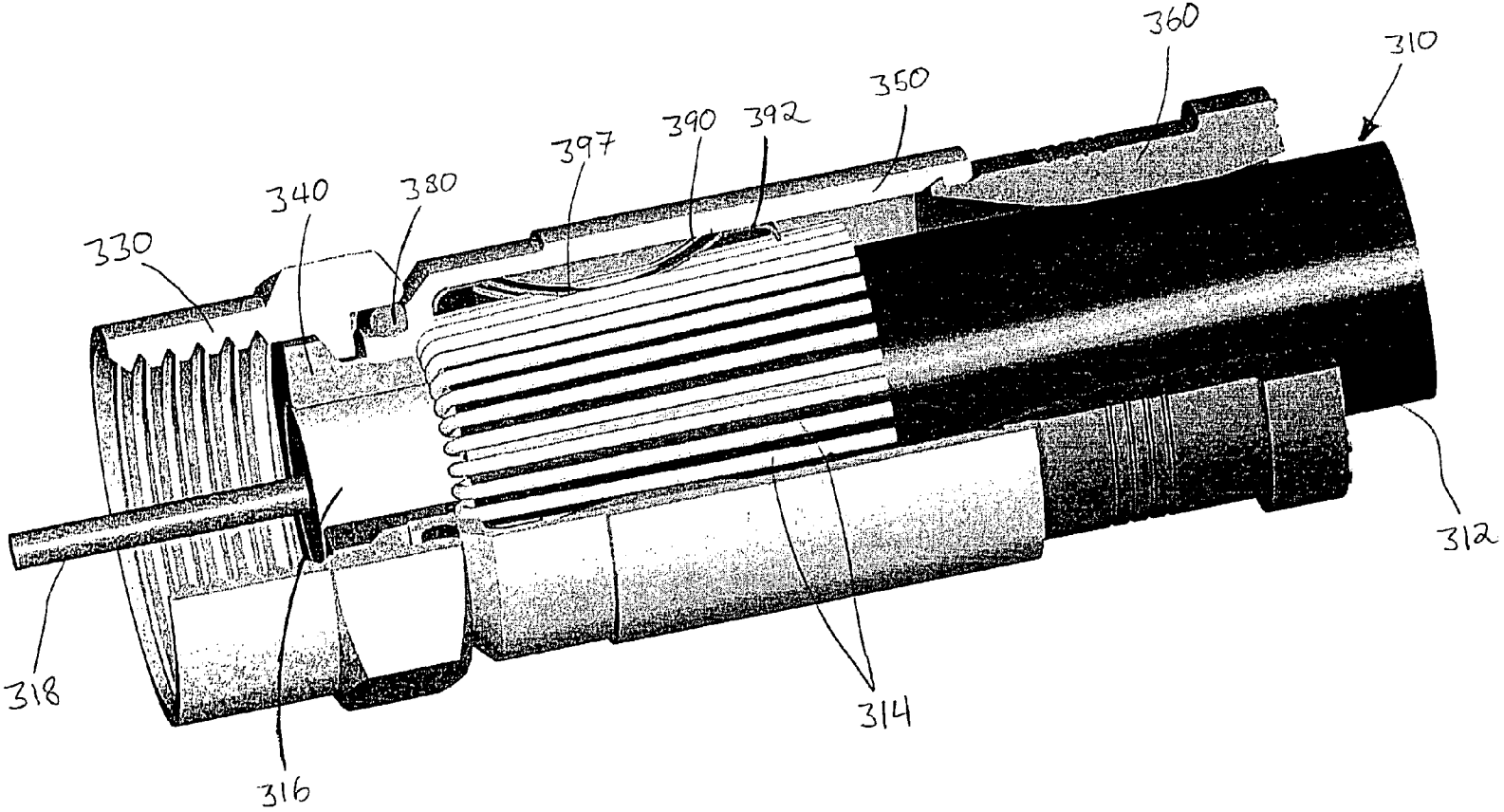
FIG. 8 depicts a cut-away perspective view of the embodiment the connector of FIG. 6 with an inserted coaxial cable, in accordance with the present invention.
Figure 2:
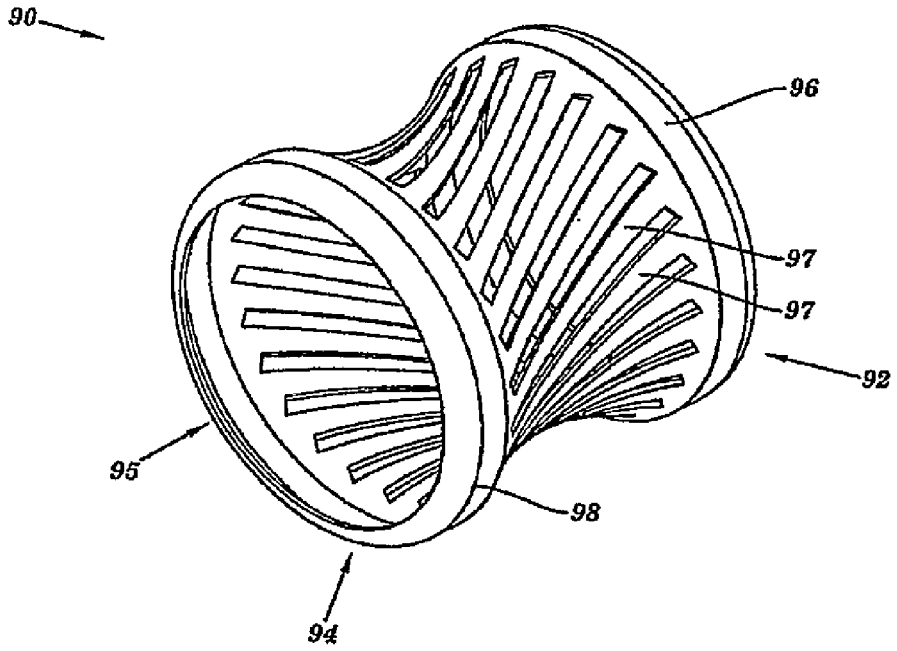
Figure 3:
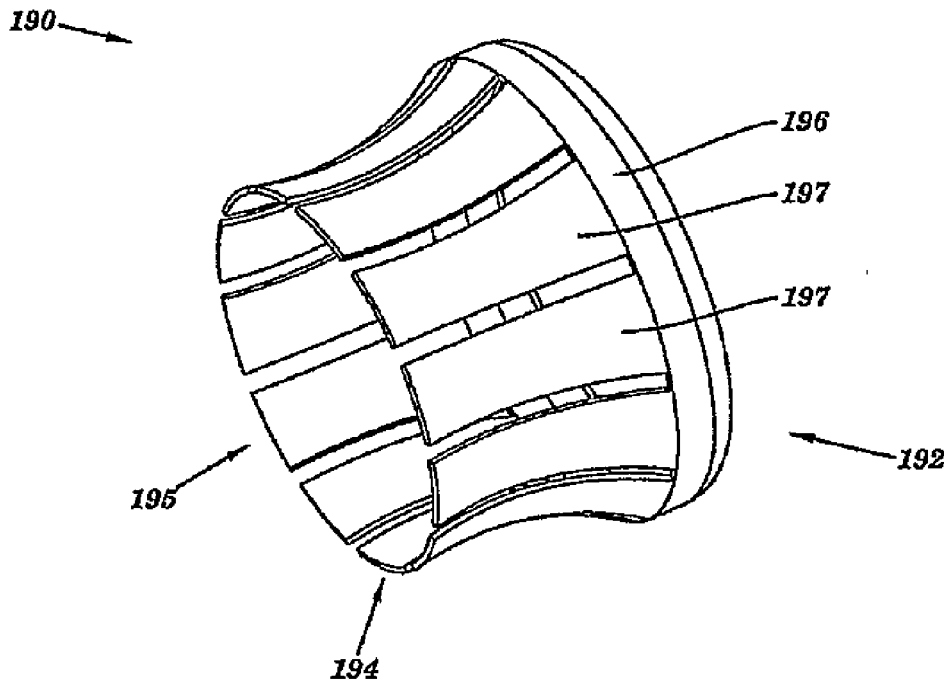
Figure 4:
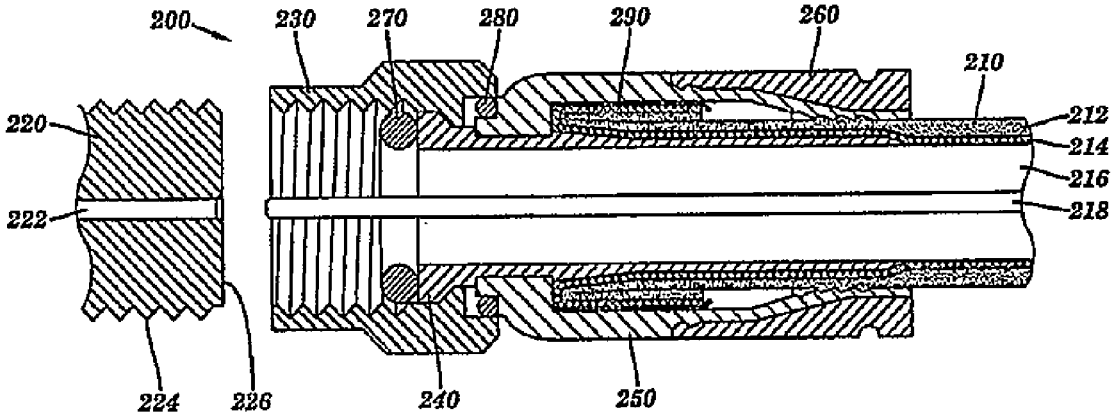
Figure 5:
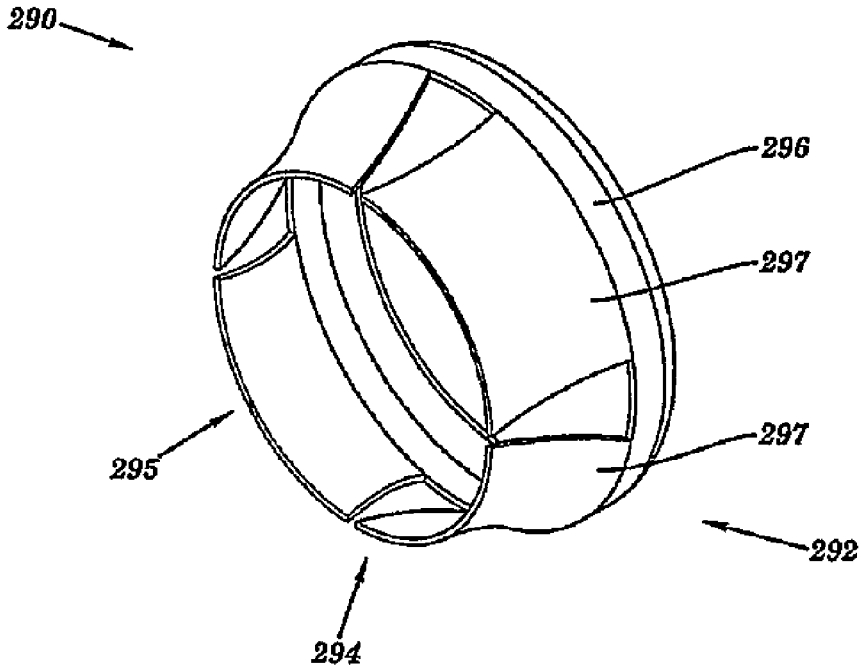
Figure 6:
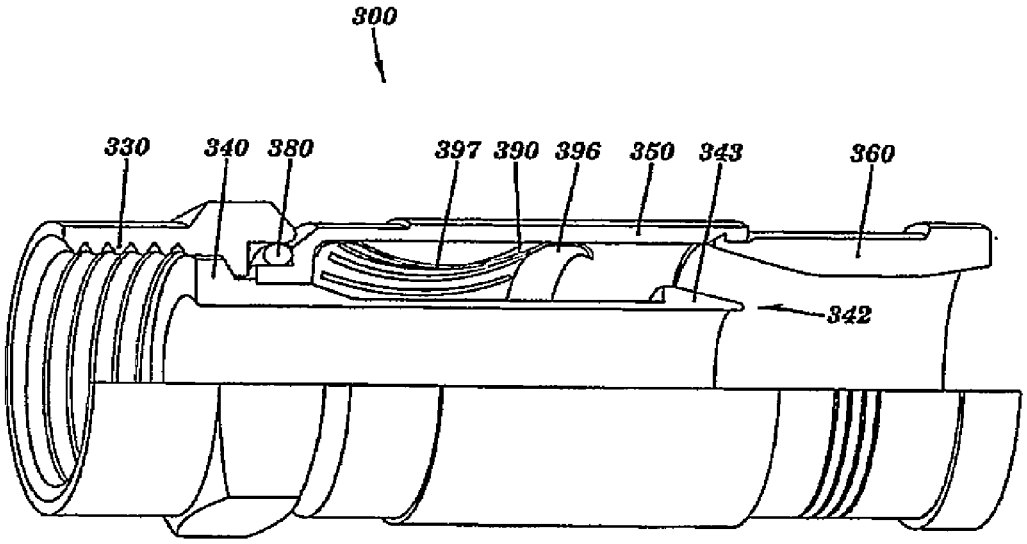
Figure 7:
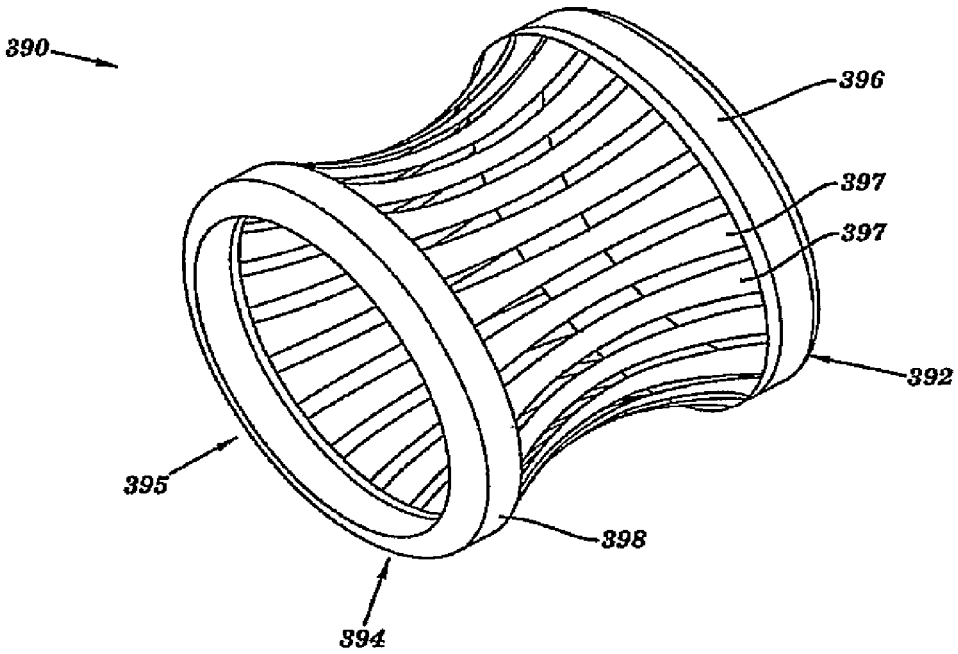
Figure 8:
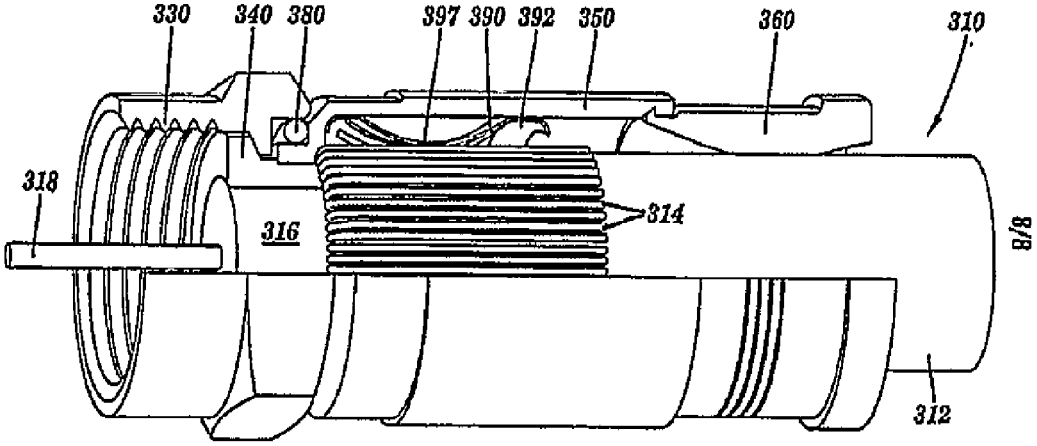

Referring further to the drawings, FIG. 6 depicts a cutaway perspective view of a further embodiment of a connector 300 without an inserted coaxial cable, in accordance with the present invention. The connector 300 may include a post element 340 at least partially housed within a connector body 350 configured to slidably engage an outer surface of a fastener member 360. As shown in FIGS. 6 and 8, a barbed portion 343 of post element 340 may cooperate with the connector body 350 to provide a generally continuous, annular, substantially 360° environmental seal and grip on the coaxial cable 310. This seal and grip may be facilitated by the movement of the fastener member 340 toward the connector body 350, thereby annularly compressing the coaxial cable 310 against the barbed portion 343 of the post element 340. Such an annular compression seal may be effective to prohibit ingress of unwanted environmental contaminants. The fastener member may be slidably moved by a compression tool. Moreover, the connector 300 may include a seal member 380 positionable between an outer surface of the connector body 350 and an inner surface of a threaded nut 330. Furthermore, the connector 300 may include a post element 340 having a first end adapted to fasten to a coaxial cable, wherein a portion of the post element 340 is positionable within a portion of an internal cavity of the connector body 350. Further still, the connector 300 may include a conductive engagement element 390 slidably positionable within a portion of an internal cavity of the connector body 350 and slidably positionable around a portion of the post element 340. The conductive engagement element may include a substantially annular ring 396 the may be configured to contact a portion of an internal surface of the connector body 350. In addition, the conductive engagement element 390 may include flexible members 397 which extend away from the substantially annular ring 396 and may bend or concave radially inward away from the internal surface of the connector body 350 and toward the outer surface of a portion of the post element 340 when positioned as shown.

Figure 7:
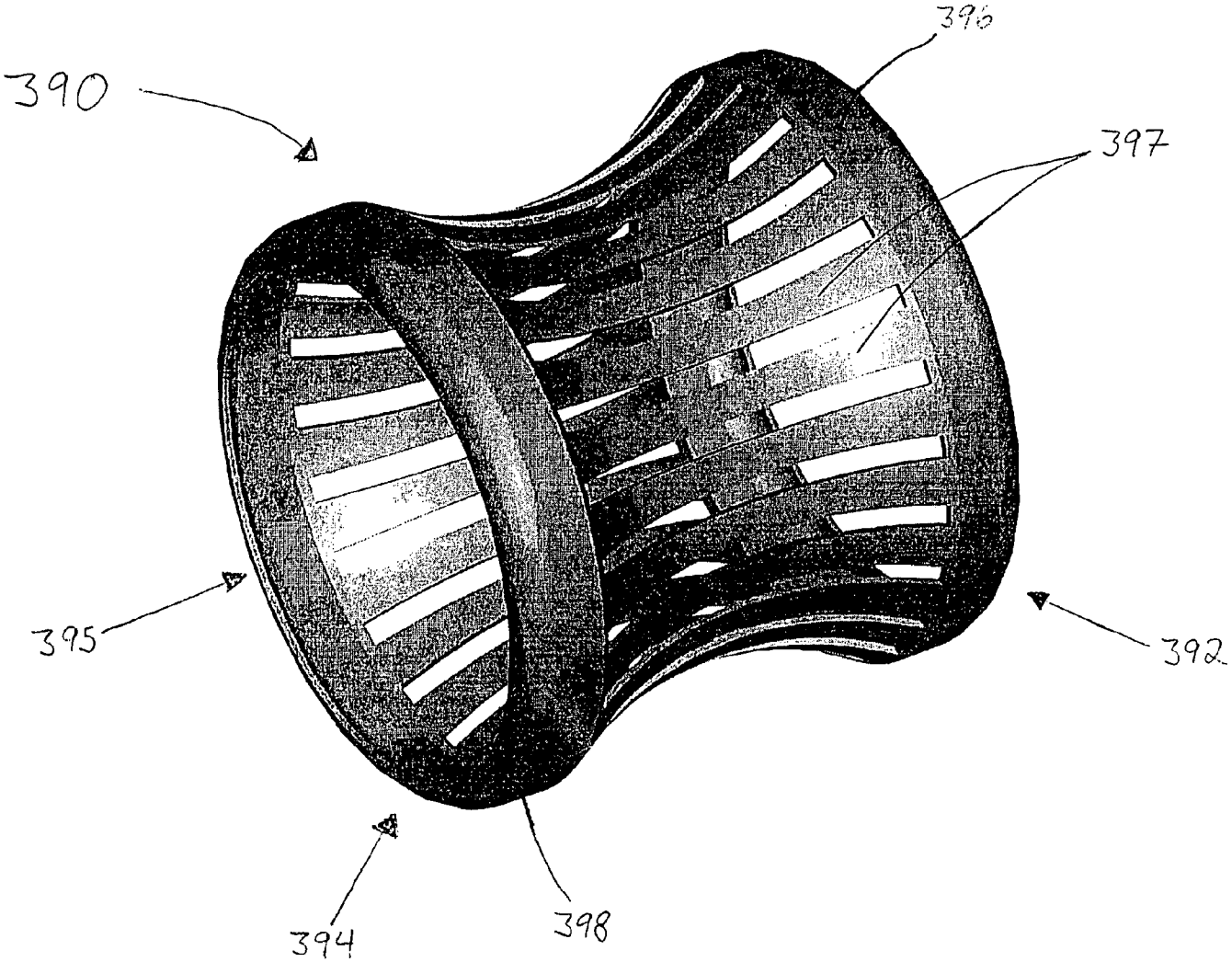
FIG. 7 depicts a perspective view of a further embodiment of a conductive engagement element, in accordance with the present invention.

With continued reference to the drawings, FIG. 7 depicts a perspective view of a further embodiment of a conductive engagement element 390, in accordance with the present invention. The conductive engagement element 390 may include a central passageway 395, wherein the central passageway 395 may reside axially between a first end 392 and opposing second end 394 of the conductive engagement element 390. Moreover, like the embodied conductive engagement element 90 shown in FIG. 2, the conductive engagement element 390 embodiment may include a substantially annular ring 396 formed at the first end 392 of the conductive engagement element 390 and may include flexible members 397 extending away from the substantially annular ring 396 and running to and connecting with another substantially annular ring 398 formed at the second end 394 of the conductive engagement element 390. Furthermore, the flexible members 397 may be separated by slots equidistantly interspersed between the flexible members 397. Like the flexible members 197 of the embodied conductive engagement element 190, the flexible members 397 of a conductive engagement element 390 embodiment may extend in a direction parallel with the axis of the substantially annular ring 396 and/or central passageway 395 and may not twist in a diagonal, helical-like fashion. Further still, the flexible members 397 of the conductive engagement element 390 embodiment may bend and concave radially inward. The conductive engagement element 390 may have a shape similar to a basket-like figure having flexible sides. Additionally, the substantially annular ring 396 and the flexible members 397 may be configured to physically and electrically contact a lengthwise portion of a coaxial cable 310 (shown in FIG. 8) and should be formed with conductive material.

Referring still further to the drawings, FIG. 8 depicts a cut-away perspective view of the embodiment the connector 300 of FIG. 6 with an inserted coaxial cable 310, in accordance with the present invention. The first end 342 (not visible) of the post element 340 may be inserted into an end of the coaxial cable 310 around the dielectric 316 and under the conductive grounding shield 314 thereof. Moreover, the conductive engagement element 390, may be slidably positionable around the post element 340 and entirely within an internal cavity of the connector body 350, wherein the conductive engagement element 390 is configured with a substantially annular ring 396 adapted to fit around the conductive grounding shield 314 of the coaxial cable 310, the substantially annular ring 396 having flexible members 397 extending therefrom and away from the first end 342 of the post element 340 when the conductive engagement element 390 is slidably positioned around the post element 340. Furthermore, the conductive engagement element 390 may be configured to substantially encircle and electrically contact a lengthwise portion of the conductive grounding shield 314 of the coaxial cable 310 as the coaxial cable 310 is received by the connector body 350 and fastened to the post element 340. Portions of the flexible members 397 of the conductive engagement element 390 may contact the coaxial cable 310 by pushing against and/or extending between various interstices or component junctures of the conductive grounding shield 314 or sheath bent back or otherwise exposed along a lengthwise portion of the coaxial cable 310. In addition, the substantially annular ring 396 may make substantial annular contact with a portion of the conductive grounding shield 314 residing along a lengthwise portion of the coaxial cable. Still further, because the substantially annular ring 396 may operate with an internal surface of the connector body 350, the ring 396 may be squeezed against the lengthwise portion of the cable 310 as received by the connector body and fastened to the post element 340, thereby increasing the physical and electrical contact of the components. The depiction of the conductive grounding shield 314 as annularly positioned wire members bent back axially over the protective outer jacket 312 of the coaxial cable 310 is not limiting of the conductive grounding shield configurations effectively possible when operating a connector 300. For example, the component elements, such as wires, wraps or foils of the conductive grounding shield may be braided, layered, twisted, wrapped, or fashioned around the dielectric 316 of the coaxial cable 310 in various manners designed to facilitate sheathing, grounding, shielding and otherwise protecting the physical and electromagnetic integrity of the communication transmission capability of the coaxial cable 310. Where the seal member 380 has conductive capability, an electromagnetic buffer may extend from the coaxial cable 310 through the conductive engagement element 390 and connector body 350 to the threaded nut 330. Additionally, an electrical shield may extend through the post element 340. The fastener member 360 may be slidably advanced into the connector body 350. The shape of the fastener member 360 may provide a secure attachment of the coaxial cable 310 by compaction of the affected components. Even further still, the compaction that may be generated by the slidable advancement of the fastener member 360 may also contribute to the physical and electrical contact of the conductive engagement element 390 with the conductive grounding shield 314 and the connector body 350 further enhancing the electrical coupling of the components and shielding of coaxial cable 310 including the center conductor 318.

Embodiments of a connector 300 may also include means for enhancing the annular electrical contact between the connector body 350 and a lengthwise portion of the conductive grounding shield 314 of the coaxial cable 310 as positioned over the first end 342 of the post element 340 when inserted into the end of the coaxial cable 310. The means may be a conductive engagement element 390 operable with the connector body 350, post element 340 and coaxial cable 310 to enlarge and extend the physical and electrical contact between the components. Such contact may include enhanced touching of the components along a lengthwise portion of the coaxial cable 310 as opposed to an end or tip thereof. Those in the art will appreciate that greater physical surface area exists pertinent to the annular surface comprising the length of the coaxial cable 310, rather then the edge of the end or tip of the cable 310 as cut or bent backward. Accordingly, the contact of the flexible members 397 and substantially annular ring 396 of the conductive engagement element 390 with the coaxial cable occurs along a lengthwise portion of the coaxial cable 310 because of the configuration and operability of the conductive engagement element 390. Hence, enhanced electrical coupling is effected through use of means including operation of a conductive engagement element 390.

A method for electrically coupling a coaxial cable 10 and a connector 100 is now described with reference to FIGS. 1–2 and 4. One method step may include providing a connector 100, wherein the connector 100 may comprise a connector body 50 having an internal cavity 55 adapted to receive the coaxial cable 10, a post element 40 adapted to be fastened to an end of the coaxial cable 10 when the cable 10 is received into the internal cavity 55 of the connector body 50, a fastener member 60, wherein said fastener member 60 may operate with the post element 40 and connector body 50 to form an annular compression seal around the coaxial cable 10, and a conductive engagement element 90 configured to substantially encircle and electrically contact a lengthwise portion of the conductive grounding shield 14 of the coaxial cable 10 as the coaxial cable 10 is received by the connector body 50 and fastened to the post element 40. The coaxial cable 10 may be prepared for connector 100 attachment. Preparation of the coaxial cable 10 may involve removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. Various other preparatory configurations of coaxial cable 10 may be employed for use with connector 100 in accordance with standard broadband communications technology and equipment. For example, the coaxial cable may be prepared without drawing back the conductive grounding shield 14, but merely stripping a portion protective outer jacket 12 to expose the conductive grounding shield 14.

An additional method step for electrically coupling a coaxial cable 10 and a connector 100 may include enhancing electrical contact between the coaxial cable 10 and the connector body 50 by fastening the post element 40 to the coaxial cable 10, positioning the conductive engagement element 90 around a lengthwise portion of the conductive grounding shield 14 of the coaxial cable 10, the lengthwise portion extending into and/or through the central passageway 95 of the conductive engagement element 90, and inserting the coaxial cable 10 into the internal cavity 55 of the connector body 50, wherein the conductive engagement element 90 may reside physically and electrically between the connector body 50 and the conductive grounding shield 14 of the coaxial cable 14 as fastened to the post element 40; and Electrical coupling a coaxial cable 10 and a connector 100 may be further attained by securing the coaxial cable 10 to the connector. Securing may in part be accomplished by insetting the coaxial cable 10 into the connector 100 such that the first end 42 of post element 40 is inserted under the conductive grounding shield or shield 14 and around the dielectric 16. Where the post element 40 is comprised of conductive material, a grounding connection may be achieved between the received conductive grounding shield 14 of coaxial cable 10 and the inserted post element 40. The ground may extend through the post element 40 from the first end 42 where initial physical and electrical contact is made with the conductive grounding shield 14 to the connector body 50 and/or threaded nut 30 which may be in contact with the post element 40. The internal cavity of the connector body 50 may receive the prepared coaxial cable 10. Once received into the internal cavity 55 of the connector body 50, the coaxial cable 10 may be securely fixed into position by radially compressing the outer surface 57 of connector body 50 against the coaxial cable 10 thereby affixing the cable into position and sealing the connection. The radial compression of the connector body 50 may be effectuated by physical deformation caused by the fastener member 60 that may compress and lock the connector body 50 into place. Moreover, where the connector body 50 is formed of materials having an elastic limit, compression may be accomplished by crimping tools or other like means that may be implemented to permanently deform the connector body 50 into a securely affixed position around the coaxial cable 10. When the connector body 50 is deformed around the coaxial cable 10 by compressing the fastener member 60 an annular seal around the coaxial cable 10 may be formed protecting the connector 100 against entry of unwanted environmental contaminants and fixing the coaxial cable 10 to the connector 100. Furthermore, when locked into position, a lengthwise portion of the conductive grounding shield 14 of the coaxial cable may be in contact with the conductive engagement element 90, which may in turn be in contact with the connector body 50.

As an additional step, electrically coupling the coaxial cable 10 and the connector 100 may be accomplished by advancing the connector 100 onto an interface port 20 (shown in FIG. 4) so that a surface of the interface port 20 mates with the connector 100. Advancement of the connector 100 onto the interface port 20 may involve the threading on of threaded nut 30 of connector 100. Threading may occur until a surface of the interface port 20 abuts a seal member 70 or the post element 40 and axial progression of the advancing connector 100 is hindered by the abutment. However, it should be recognized that embodiments of the connector 100 may be advanced onto an interface port 20 without threading and involvement of a threaded nut 30 and/or advancement need not proceed until the interface port abuts either the seal member 70 or post element 40. Where advancement is stopped by the abutment of seal member 70 or post element 40 with interface port 20, the connector 100 may be further shielded from ingress of unwanted electromagnetic interference if the seal member 70 or post element 40 are comprised of conductive materials.

With continued reference to FIGS. 1–2 and 4 and additional reference to FIG. 6, further depiction of a method for electrically coupling a coaxial cable 10 and a connector 300 is described. The connector 300 including a post element 340, connector body 350 and a fastener member 360 may be provided. Moreover, the connector body 350 may be configured such that an internal surface of the connector body 350 slidably engages an external surface of the fastener member 360. Securing of the connector 300 and the cable 10 may be accomplished by compressing the fastener member 360 into the connector body 350. The fastener member 360 may be compressed by a force-enhancing tool. The compression may form an annular seal around the coaxial cable 10 and may facilitate secure electrical and physical positioning of the conductive engagement element 90 between the connector body 350 and the conductive grounding shield 14 of the coaxial cable 10. Accordingly, the electrical couple of the connector 300 and cable 10 may be enhanced.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A connector for coupling an end of a coaxial cable, the coaxial cable having a center conductor surrounded by a dielectric, the dielectric being surrounded by a conductive grounding shield, the conductive grounding shield being surrounded by a protective outer jacket, said connector comprising:

a connector body, having an internal cavity;

a post element, operable within the internal cavity of the connector body, the post element having a first end adapted to be inserted into an end of the coaxial cable around the dielectric and to engage the conductive grounding shield thereof;

a conductive engagement element, slidably positionable around the post element and entirely within the internal cavity of the connector body, wherein the conductive engagement element is configured with a substantially annular ring adapted to fit around the conductive grounding shield of the coaxial cable, the substantially annular ring having flexible members extending therefrom and away from the first end of the post element when the conductive engagement element is slidably positioned around the post element; and a fastener member, wherein said fastener member facilitates an annular environmental seal around the coaxial cable as said fastener member is compressed toward the connector body.

2. The connector of claim 1 further comprising a threaded nut.

3. The connector of claim 1, wherein the flexible members are divided by slots equidistantly interspersed between the flexible members.

4. The connector of claim 1, wherein the flexible members of the conductive engagement element further extend in a direction parallel with the axis of the substantially annular ring.

5. The connector of claim 1, wherein the flexible members of the conductive engagement element further extend in a diagonal, helical-like fashion forming a twisted casing-like structure surrounding a central passageway of the conductive engagement element.

6. The connector of claim 1, wherein the flexible members of the conductive engagement element further extend to and connect with another substantially annular ring formed on the conductive engagement element.

7. A connector for coupling an end of a coaxial cable, the coaxial cable having a center conductor surrounded by a dielectric, the dielectric being surrounded by a conductive grounding shield, the conductive grounding shield being surrounded by a protective outer jacket, said connector comprising:

a connector body, having a first end for receiving the coaxial cable;

a post element, adapted to be fastened to an end of the coaxial cable when the cable is received into the first end of the connector body;

a fastener member, wherein said fastener member operates with the post element and connector body to form an annular compression seal around the coaxial cable; and a conductive engagement element having flexible members divided by equidistantly interspersed slots, said conductive engagement element configured to substantially encircle and electrically contact a lengthwise portion of the conductive grounding shield of the coaxial cable as the coaxial cable is received by the connector body and fastened to the post element.

8. The connector of claim 7 further comprising a threaded nut.

9. The connector of claim 7, wherein the flexible members of the conductive engagement element further extend in a direction parallel with the axis of the substantially annular ring.

10. The connector of claim 7, wherein the flexible members of the conductive engagement element further extend in a diagonal, helical-like fashion forming a twisted casing-like structure surrounding a central passageway of the conductive engagement element.

11. The connector of claim 7, wherein the flexible members of the conductive engagement element further extend to and connect with another substantially annular ring formed on the conductive engagement element.

12. A method for electrically coupling a coaxial cable and a connector, the coaxial cable having a center conductor surrounded by a dielectric, the dielectric being surrounded by a conductive grounding shield, the conductive grounding shield being surrounded by a protective outer jacket, said method comprising:

providing a connector, wherein the connector includes a connector body having an internal cavity adapted to receive the coaxial cable, a post element adapted to be fastened to an end of the coaxial cable when the cable is received into the internal cavity of the connector body, a fastener member, wherein said fastener member operates with the post element and connector body to form an annular compression seal around the coaxial cable, and a conductive engagement element, configured to substantially encircle and electrically contact a lengthwise portion of the conductive grounding shield of the coaxial cable as the coaxial cable is received by the connector body and fastened to the post element;

enhancing electrical contact between the coaxial cable and the connector body by fastening the post element to the coaxial cable, positioning the conductive engagement element around a lengthwise portion of the conductive grounding shield of the coaxial cable, and inserting the coaxial cable into the internal cavity of the connector body, wherein the conductive engagement element resides physically and electrically between the connector body and the conductive grounding shield of the coaxial cable as fastened to the post element; and securing the coaxial cable to the connector by slidingly compressing the fastener member and forming an annular seal around the coaxial cable protecting the connector against entry of unwanted environmental contaminants and fixing the cable to the connector.

13. The method of claim 12, wherein securing the coaxial cable to the connector is facilitated by the compression of a fastener member.

14. The method of claim 12, further comprising a step of advancing the connector onto an interface port.

15. The method of claim 14, wherein the connector includes a threaded nut facilitating threaded advancement of the connector onto the interface port.

* * * * *

UNITED STATES PATENT AND TRADEMARK OFFICE

CERTIFICATE OF CORRECTION

PATENT NO. : 7,097,499 B1
APPLICATION NO. : 11/206726
DATED : August 29, 2006
INVENTOR(S) : Eric Purdy It is certified that error appears in the above-identified patent and that said Letters Patent is hereby corrected as shown below:

The title page should be deleted and substitute therefore the attached title page.

Drawings:

Delete Drawing sheets 1-8 and substitute therefore the drawing sheets 1-8 as shown on the attached pages.

Signed and Sealed this

Second Day of January, 2007

JON W. DUDAS
*Director of the United States Patent and Trademark Office*

(12) United States Patent
Purdy

(10) Patent No.: US 7,097,499 B1
(45) Date of Patent: Aug. 29, 2006

(54) COAXIAL CABLE CONNECTOR HAVING CONDUCTIVE ENGAGEMENT ELEMENT AND METHOD OF USE THEREOF

(75) Inventor: Eric Purdy, Constantia, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/206,726

(22) Filed: Aug. 18, 2005

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS

| | | | | |
|---|---|---|---|---|
| 3,879,102 | A | 4/1975 | Horak | |
| 4,260,663 | A | 9/1981 | Fowler et al. | |
| 4,355,857 | A | 10/1982 | Hayward | |
| 4,739,126 | A | 4/1988 | Gutter et al. | |
| 4,902,246 | A | 2/1990 | Sanchuca | |
| 5,046,952 | A | 9/1991 | Cohen et al. | |
| 5,066,248 | A | 11/1991 | Gaver, Jr. et al. | |
| 5,181,861 | A | 1/1993 | Gaver, Jr. et al. | |
| 5,460,544 | A | 10/1995 | Insko et al. | |
| 5,470,257 | A | 11/1995 | Szegda | |
| 5,803,767 | A | 9/1998 | Matsumoto et al. | |
| 5,931,698 | A | 8/1999 | Kodama | |
| 6,089,912 | A | 7/2000 | Tallis et al. | |
| 6,153,830 | A * | 11/2000 | Montena | 174/88 C |
| 6,203,368 | B1 | 3/2001 | Werdner | |
| 6,217,383 | B1 | 4/2001 | Holland et al. | |
| 6,262,374 | B1 | 7/2001 | Matsumoto et al. | |
| 6,648,683 | B1 | 11/2003 | Youtsey | |
| 6,700,464 | B1 | 3/2004 | Ling et al. | |
| 6,729,911 | B1 | 5/2004 | Hu | |
| 6,805,583 | B1 | 10/2004 | Holliday et al. | |
| 6,808,415 | B1 * | 10/2004 | Montena | 439/584 |
| 6,809,265 | B1 | 10/2004 | Gladd et al. | |
| 6,910,919 | B1 | 6/2005 | Hung | |
| 2003/0095015 | A1 | 5/2003 | Loeffelholz et al. | |

* cited by examiner

*Primary Examiner*—Ross Gushi
(74) *Attorney, Agent, or Firm*—Schmeiser, Olsen & Watts

(57) ABSTRACT

A coaxial cable connector is provided, wherein the connector comprises a conductive engagement element slidably positionable around a post element of the connector and entirely within an internal cavity of a connector body of the connector. The conductive engagement element is configured to physically and electrically contact a lengthwise portion of a coaxial cable as securely affixed to the connector with a fastener member facilitating an annular environmental seal between the cable and the connector.

15 Claims, 8 Drawing Sheets

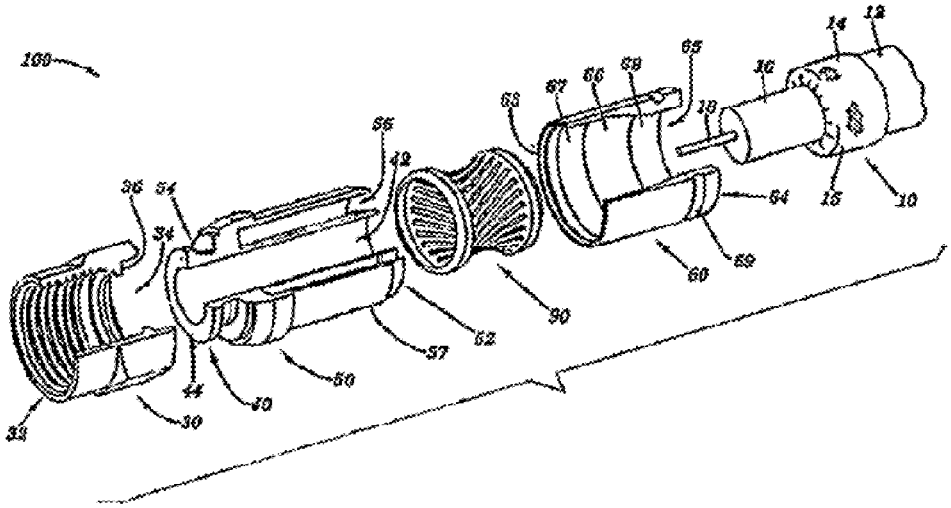

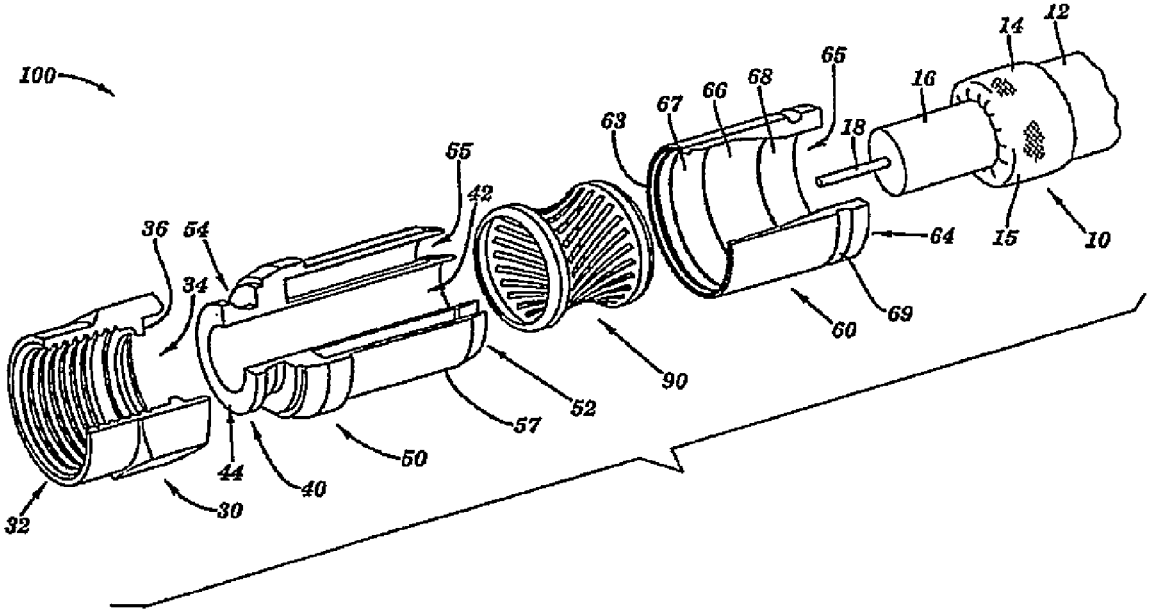
100
14
12
65
16
68
66
67
63
18
55
42
36
54
34
64
15
10
69
60
90
52
57
50
44
40
30
32